United States Patent [19]

Rühle

[11] Patent Number: 4,495,825

[45] Date of Patent: Jan. 29, 1985

[54] STARTER FOR INTERNAL COMBUSTION ENGINES

[75] Inventor: Walter Rühle, Korntal, Fed. Rep. of Germany

[73] Assignee: Robert Bosch GmbH, Stuttgart, Fed. Rep. of Germany

[21] Appl. No.: 413,343

[22] PCT Filed: Oct. 31, 1981

[86] PCT No.: PCT/DE81/00184

§ 371 Date: Aug. 11, 1982

§ 102(e) Date: Aug. 11, 1982

[87] PCT Pub. No.: WO82/02419

PCT Pub. Date: Jul. 22, 1982

[30] Foreign Application Priority Data

Jan. 14, 1981 [DE] Fed. Rep. of Germany ..... 3100869

[51] Int. Cl.[3] ..... F02N 15/06

[52] U.S. Cl. ..... 74/7 E; 74/7 A

[58] Field of Search ..... 74/7 R, 7 A, 7 E

[56] References Cited

U.S. PATENT DOCUMENTS

| | | | |
|---|---|---|---|
| 2,998,729 | 9/1961 | Warsaw | 74/7 |
| 3,024,780 | 3/1962 | Hamman | 74/7 X |
| 3,182,515 | 5/1965 | Klein | 74/7 |
| 3,922,558 | 11/1975 | Hollyoak | 74/7 A X |
| 4,104,926 | 8/1978 | Wilson | 74/7 R X |
| 4,192,195 | 3/1980 | Kazino et al. | 74/7 A |
| 4,346,615 | 8/1982 | Yoneda et al. | 74/7 E X |

FOREIGN PATENT DOCUMENTS

| | | | |
|---|---|---|---|
| 1258192 | 1/1968 | Fed. Rep. of Germany . | |
| 1311876 | 11/1962 | France . | |
| 55-98661 | 7/1980 | Japan | 74/7 E |
| 964675 | 7/1964 | United Kingdom . | |

OTHER PUBLICATIONS

Patent Abstracts of Japan, Band 4, No. 128 (m-31) (610) Sep. 9, 1980, and Band 4, No. 147 (M-36) (629) Oct. 16, 1980.

*Primary Examiner*—Allan D. Herrmann

*Attorney, Agent, or Firm*—Frishauf, Holtz, Goodman & Woodward

[57] ABSTRACT

A starter for internal combustion engines is proposed in which a spur gear arrangement (16, 17) is inserted between a drive shaft 4 of a starter motor (1) and a gear shaft (20), on which gear shaft a meshing gear (39–42 and 29) having a starting pinion (31) is movably disposed. The internally geared wheel (17) of the gear arrangement is formed in one piece with a bearing sleeve (18) carrying a high-pitch (spiral spline) thread (19) and is located on the gear shaft (20). The coupling element (26) of the free wheel (29) is seated on the high-pitch thread (19), thus shortening the structural length. A cover cap (51) fitting around the internally geared wheel (17) is inserted between an intermediate (casing 8, 53) and a drive bell (10, 54) and seals off the gear arrangement (16, 17) in lubricant-tight manner with respect to the interior of the drive bell (10).

6 Claims, 1 Drawing Figure

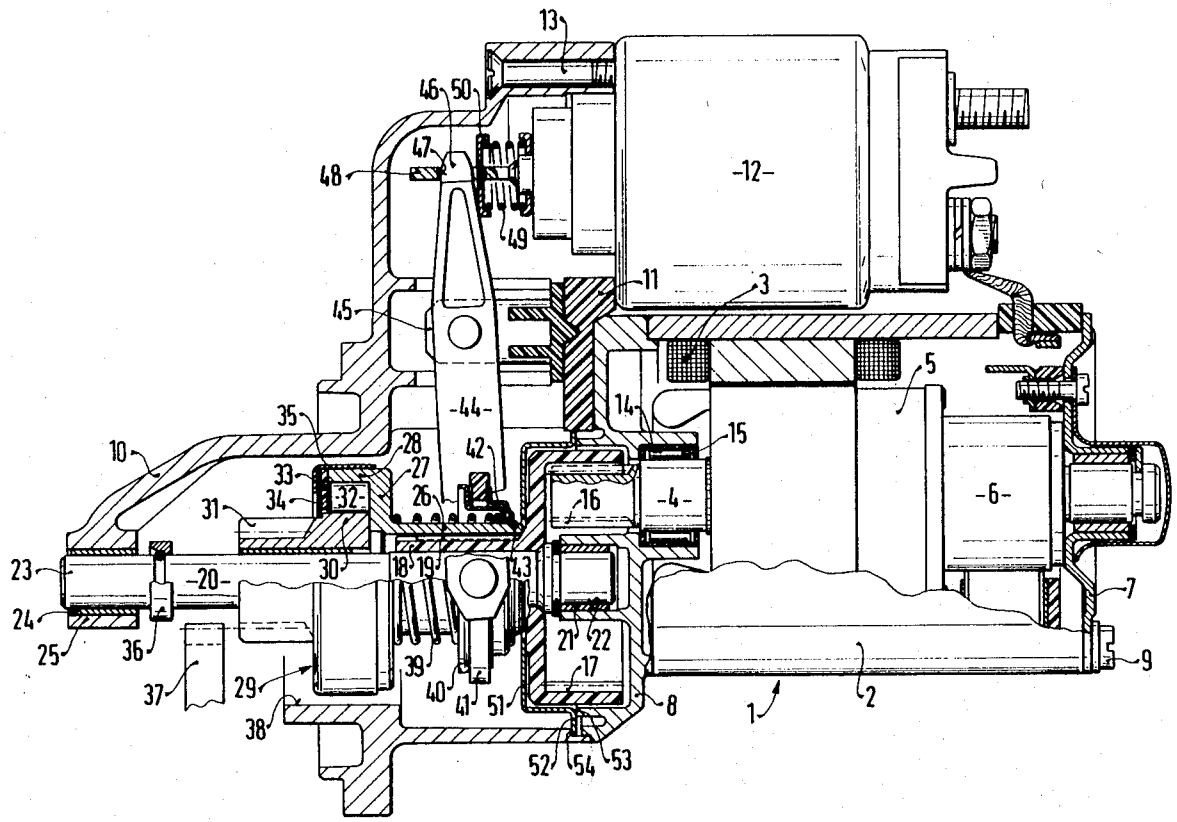
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54

STARTER FOR INTERNAL COMBUSTION ENGINES

The invention relates generally to a starter for internal combustion engines and more particularly to a starter in which the starter motor is connected to the starter pinion by means of a spur gear arrangement having an internally geared wheel, a freewheel, and a coupling element around the gear shaft.

BACKGROUND

In a known starter of this type, the internally geared wheel of the spur gear arrangement is separately embodied and, adjoining the gear shaft, is secured via an axial gearing on the gear shaft to a high-pitch thread in a positively engaged manner. The disadvantage of such an arrangement is that the connection between the internally geared wheel and the gear shaft is relatively weak, and the internally geared wheel has a relatively short seated length on the gear shaft, presenting the danger of premature wear caused by breakage and canting.

A spur gear arrangement is also known, the internally geared wheel of which is provided with a bearing extension. Although the internally geared wheel having the bearing extension is pressed onto the gear shaft, still the pressure connection between them is sufficient for transmission of only a certain maximal torque. If this maximal torque is exceeded, then the internally geared wheel and the gear shaft rotate at different speeds. Although this effect is exploited for the purpose of shock absorption, still the relatively long structure is disadvantageous, because the high-pitch thread section of the gear shaft on which the coupling element of the free wheel is seated must be disposed following the area where the bearing extension of the internally geared wheel is secured.

THE INVENTION

Briefly, the starter for internal combustion engines of the present invention, with its coupling element disposed on a highly pitched spirally splined sleeve, and its internally geared wheel journalled on the spur gear shaft, has the advantage that the internally geared wheel, which is embodied in one piece with the sleeve, has a long guideway length on a relatively thin gear shaft (thus saving raw materials), with which it does not have to be rigidly connected because at the same time the internally geared wheel also includes the high-pitch thread section. As a result, the structural length of the starter can be kept shorter, and the thin gear shaft is not required to be a part which transmits torque.

By means of the integral formation of the splined sleeve and internally geared wheel, and the cover cap sealingly surrounding the internally geared wheel advantageous further embodiments of the starter disclosed in claim 1 are possible. It is particularly advantageous that by embodying the internally geared wheel having the high-pitch thread sleeve as an extruded or injection-molded plastic part, the number of separate parts can be reduced, thus also reducing the cost of assembly. Furthermore, the space-saving embodiment and disposition mean that with simple means, lubricant leakage from the gear arrangement can be prevented.

DRAWING

The single FIGURE shows a starter seen partially in longitudinal section.

DESCRIPTION OF THE EXEMPLARY EMBODIMENT

A starter has a starter motor 1 having a housing 2, in which an exciter winding 3 is secured. A drive shaft 4 carries an armature 5 and a commutator 6. The drive shaft 4 is rotatably supported with its end toward the commutator in a bearing cap 7 and with its other end in an intermediate casing 8. In a manner known per se, the bearing cap 7 and intermediate casing 8 are secured, each to a respective end of the housing 2, with tie rods 9. On the other end of the intermediate casing 8, a drive bell 10 is screwed in place in a manner also known per se and not shown in further detail. Parallel to the intermediate casing 8, an engagement relay 12 is secured to the drive bell 10 with screws 13, a sealing element 11 being disposed between the relay 12 and drive bell 10.

In the intermediate casing 8, there is a first bearing bore 14, in which a bearing 15 is inserted, in which the drive shaft 4 is rotatably received. One end of the drive shaft 4 is rotatably received in the bearing cap 7. The other end of the drive shaft 4, protruding through the bearing 15, is provided with an axial gearing 16 and serves as the driving wheel 16 of a spur gear arrangement. The spur gear arrangement has an internally geared wheel 17, which is in engagement with the axial gearing 16. The internally geared wheel 17 is embodied in one piece with a bearing sleeve 18. The part comprising the internally geared wheel 17 and the bearing sleeve 18 is embodied as an extruded part, by way of example; it may also be realized as an injection-molded plastic part. A high-pitch thread 19 is formed on the outside of the bearing sleeve 18 at the same time. The internally geared wheel 17 having the bearing sleeve 18 is supported on a gear shaft 20. One end of the gear shaft 20 is rotatably received in a bearing 21, which is inserted into a second bearing bore 22 of the intermediate bell 10. The second end 23 of the gear shaft 20 is rotatably received in a bearing 24 of a bearing extension 25 of the drive bell 10.

A coupling element 26 is screwably disposed on the high-pitch thread 19 of the bearing sleeve 18 seated on the gear shaft 20. The coupling element 26 is integrally connected via a flange 27 with an outer race 28 of a free wheel 29. An inner race 30 of the free wheel 29 is embodied as an extension of a starter pinion 31, which is seated rotatably and displaceably on the gear shaft 20. The races 28 and 39 enclose chambers in which rollers 32 and associated springs, not shown, are accommodated. A cover plate 33 closes off the chambers. A shim 34 rests on the outer side of the cover plate 33. A closure element 35 secured on the outer race 28 overlaps the shim 34 and holds the free wheel elements 28, 30, 32, 33, 34 together.

A stop ring 36 is disposed on the gear shaft 20 near the bearing extension 25. Between the starter pinion 31 and the stop ring 36, a crown gear 37 of an internal combustion engine which is to be started protrudes through a jaw-like opening 38 of the drive bell 10 into the engagement zone of the starter pinion 31.

A meshing spring 39 is seated on the coupling element 26 between the flange 27 and a first stop sleeve 40 also disposed on the coupling element 26. A coupling plate 41 is disposed in an axially and radially movable manner between the first stop sleeve 40 and a second stop sleeve 42. The second stop sleeve 42 rests on a stop ring 43 of the coupling element 26. The coupling plate 41 is articulated on a fork-like engaging lever 44. The engaging lever 44 is pivotably supported on a bearing element 45. The bearing element 45 is inserted into recesses of the drive bell 10.

The free end 46 of the engaging lever 44 protrudes into a slit 47 of a shifting rod 48 of a magnet armature, not shown further, of the engagement relay 12. A restoring spring 49 is disposed between the end 46 of the engaging lever 44 and the engagement relay 12, one end of the spring 49 resting on a spring bearing 50. The spring bearing 50 is strip-like in embodiment and also extends through the slit 47 of the shifting rod 38, and its ends, bent at right angles, overlap the adjoining end section of the restoring spring 49.

A cover cap 51 is embodied in a substantially bowl-like shape. It surrounds the internally geared wheel 17 protruding into the drive bearing 10, and the bell 10 sleeve 18 together with the gear shaft 20 extend through a hole in the base of the cover cap 51. The flangelike rim 52 of the cover cap 51 is inserted between a protruding abutment rim 53 of the intermediate bearing 8 on the one hand and an inner shoulder 54 on the end face 54 of the drive bell 10 on the other. As a result, the starter motor 1 having the spur gear arrangement 16, 17 is closed off with respect to the drive bell 10, which is open via the jaw-like opening 38, such as to be dirtproof and dampproof. Furthermore, the lubricant introduced into the gear arrangement 16, 17 can no longer be thrown out by centrifugal force or run out as a result of the rotation of the spur gear arrangement 16, 17 during the process of starting the engine.

I claim:

1. A starter for an internal combustion engine comprising:

a starter motor (1) having an output drive shaft (4) with a toothed end section (16);

a starter pinion (31), disposed in a rotatable and longitudinally movable manner on a gear shaft (20);

a sleeve (18) disposed around said gear shaft (20) and having a highly pitched spirally splined section (19);

a spur gear arrangement (16,17,18) including said drive shaft, a freewheel (29) and a coupling element (26), which is movably disposed on said high-pitch thread (spiral spline) section (19), operatively connecting the starter pinion (31) to the spur gear, wherein the spur gear arrangement has an internally geared wheel (17), said internally geared wheel (17) is integrally formed with said sleeve (18);

said coupling element (26) is seated on said sleeve (18); and said internally geared wheel (17) is journalled on the gear shaft (20) and is in meshing engagement with said toothed end section (16) provided on the drive shaft (4).

2. A starter as defined by claim 1, characterized in that the internally geared wheel (17) integral with the sleeve (18) is formed as an extruded part.

3. A starter as defined by claim 1, characterized in that the internally geared wheel (17) integral with the sleeve (18) is formed as an injection-molded plastic part.

4. A starter as defined by claim 1, further comprising an intermediate casing (8) between said motor (1) and said spur gear arrangement (16,17,18), characterized in that a cover cap (51) is provided, resting on the intermediate casing (8), which cover cap sealingly surrounds and overlaps the internally geared wheel (17).

5. A starter as defined by claim 2, further comprising an intermediate casing (8) between said motor (1) and said spur gear arrangement (16,17,18), characterized in that a cover cap (51) is provided, resting on the intermediate casing (8), which cover cap sealingly surrounds and overlaps the internally geared wheel (17).

6. A starter as defined by claim 3, further comprising an intermediate casing (8) between said motor (1) and said spur gear arrangement (16,17,18), characterized in that a cover cap (51) is provided, resting on the intermediate casing (8), which cover cap sealingly surrounds and overlaps the internally geared wheel (17).

* * * * *